US008240369B1

(12) United States Patent
Nikouline et al.

(10) Patent No.: US 8,240,369 B1
(45) Date of Patent: Aug. 14, 2012

(54) SLOT-PERFORATING SYSTEM FOR OIL, GAS AND HYDRO-GEOLOGICAL WELLS

(75) Inventors: Anatoli Nikouline, Aurora (CA); Nikolai Korvet, St.-Peterburg (RU)

(73) Assignee: Go Energy, Inc., San Francisco, CA (US)

( * ) Notice: Subject to any disclaimer, the term of this patent is extended or adjusted under 35 U.S.C. 154(b) by 0 days.

(21) Appl. No.: 13/373,004

(22) Filed: Nov. 2, 2011

(51) Int. Cl.
*E21B 43/114* (2006.01)

(52) U.S. Cl. ..... 166/55.2; 166/298

(58) Field of Classification Search ..... 166/55.2, 166/55.6, 55.7, 55.8, 376, 298; 83/177; 175/424
See application file for complete search history.

(56) References Cited

U.S. PATENT DOCUMENTS

| | | | | |
|---|---|---|---|---|
| RE21,085 | E * | 5/1939 | O'Neill | 166/298 |
| 3,130,786 | A * | 4/1964 | Brown et al. | 175/424 |
| 4,227,582 | A * | 10/1980 | Price | 175/16 |
| 5,337,825 | A * | 8/1994 | Marmorstein et al. | 166/307 |
| 6,651,741 | B2 * | 11/2003 | Bassin et al. | 166/268 |
| 7,073,587 | B2 * | 7/2006 | Bassin et al. | 166/298 |
| 7,140,429 | B2 * | 11/2006 | Grebennikov et al. | 166/55 |
| 7,568,525 | B2 * | 8/2009 | Veselkov | 166/298 |
| 2007/0187086 | A1 * | 8/2007 | Ivanov et al. | 166/55.2 |
| 2009/0101414 | A1 * | 4/2009 | Brunet et al. | 175/62 |

* cited by examiner

*Primary Examiner* — Daniel P Stephenson
(74) *Attorney, Agent, or Firm* — Henry M. Feiereisen

(57) ABSTRACT

A slot-perforating system for an abrasive-hydro-slotting of a near well-bore zone for establishing an inflow path between a borehole and a formation has an adaptor connectable to a tubing; a hydraulic block connected to the adaptor for regulating a speed of operation; a perforator providing a hydro-slotting, and a return block located between the hydraulic block and the perforator and returning the perforator an initial upper position.

11 Claims, 9 Drawing Sheets

DETAIL 1

SLOT-PERFORATING SYSTEM FOR OIL, GAS AND HYDRO-GEOLOGICAL WELLS

BACKGROUND OF THE INVENTION

The present invention relates to equipment for excavation, and in particular to systems for opening formations in gas, oil and hydro-geological wells.

Systems are known, which comprise a set of equipment including at its bottom end a working unit which directs a high-speed hydraulic jet that contains abrasive particles, toward a prospective productive formation to cut through the casing and the ring and to produce slot-shaped passages in a formation, so as to provide a flow from the formation into the borehole. It is believed that the existing systems of this type can be further improved.

SUMMARY OF THE INVENTION

Accordingly, it is an object of the present invention to provide a slot-perforating system for oil, gas and hydro-geological wells that includes a working unit which generates and directs a working fluid to cut slot shaped passages in a productive formation, which is a further improvement of the existing systems.

In keeping with these objects and with others which will become apparent hereinafter, one feature of the present invention resides, briefly stated, in a slot-perforating system for an abrasive-hydro-slotting of a near well-bore zone for establishing an inflow path between a well-bore and a formation, comprising an adaptor connectable to a tubing; a hydraulic block connected to said adaptor for regulating a speed of operation; a perforator providing a hydro-slotting, and a return block located between said hydraulic block and said perforator and returning said perforator an initial upper position.

In accordance with another feature of the present invention to adaptor can be formed so that during a downward movement said perforator is turnable around a vertical axis to provide a cut at an angle.

In the inventive system the adaptor can be provided with formations engaging in helical grooves to generate a spiral movement of the perforator which produces the angular cut.

The perforator of the inventive system can have a streamline shape. For this purpose the perforator is formed as a body of rotation around a substantially vertical axis with a substantially elliptical vertical cross-section.

In the inventive system centering elements can be provided and can include at least one set of springy elements which are spaced from one another in a circumferential direction about a vertical axis and each extending along the slot perforating hydraulic system to abut against an inner surface of a wellbore when the slot perforating system is located in said wellbore.

Also, the system can include another set of the spring elements which is offset from the first mentioned set, and wherein each of said spring elements has one end is connected to said slot-perforating system and another end which is not connected to the latter.

Another feature of the present invention is that the hydraulic block includes means for regulating a supply of a hydraulic liquid depending on a temperature in the borehole. The regulating means can include a bimetal regulating means which change their orientation in dependence on the temperature in the borehole.

In the inventive system the return block can include spring elements providing the return of said perforator and including a plurality of springs which are arranged one after the other in a vertical direction. The return block can also include a cylinder accommodating said springs, connecting rods located inside said springs, stop elements provided between said springs, and ring elements surrounding each of said stop elements and sliding over an inner surface of said cylinder, wherein said ring elements are configured as elements having a low friction with the inner surface of said cylinder.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
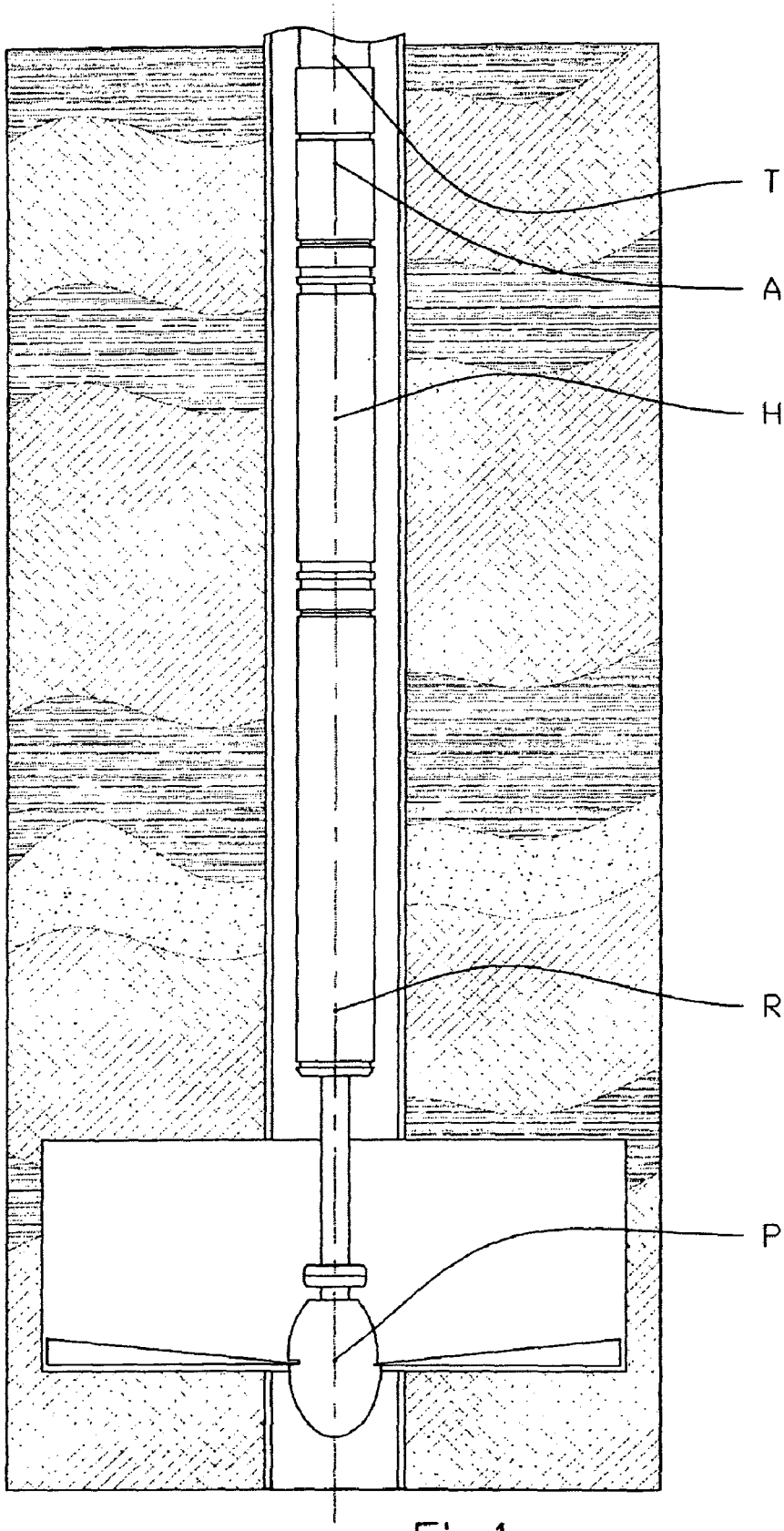
FIG. 1 is a view schematically showing a system a slot-perforating system for oil, gas and hydro-geological wells.

A system for excavation with the use of a slot perforation for forming slot-shaped passages in a formation and communicating it with a wellbore to establish a flow path between the formation and the wellbore is shown in general in FIG. 1. It includes an adaptor A connectable to a tubing T, a hydraulic unit H, a perforator P, and a return block R located between the hydraulic unit H and the perforator P, as shown in this Figure.

Figures 2, 3:
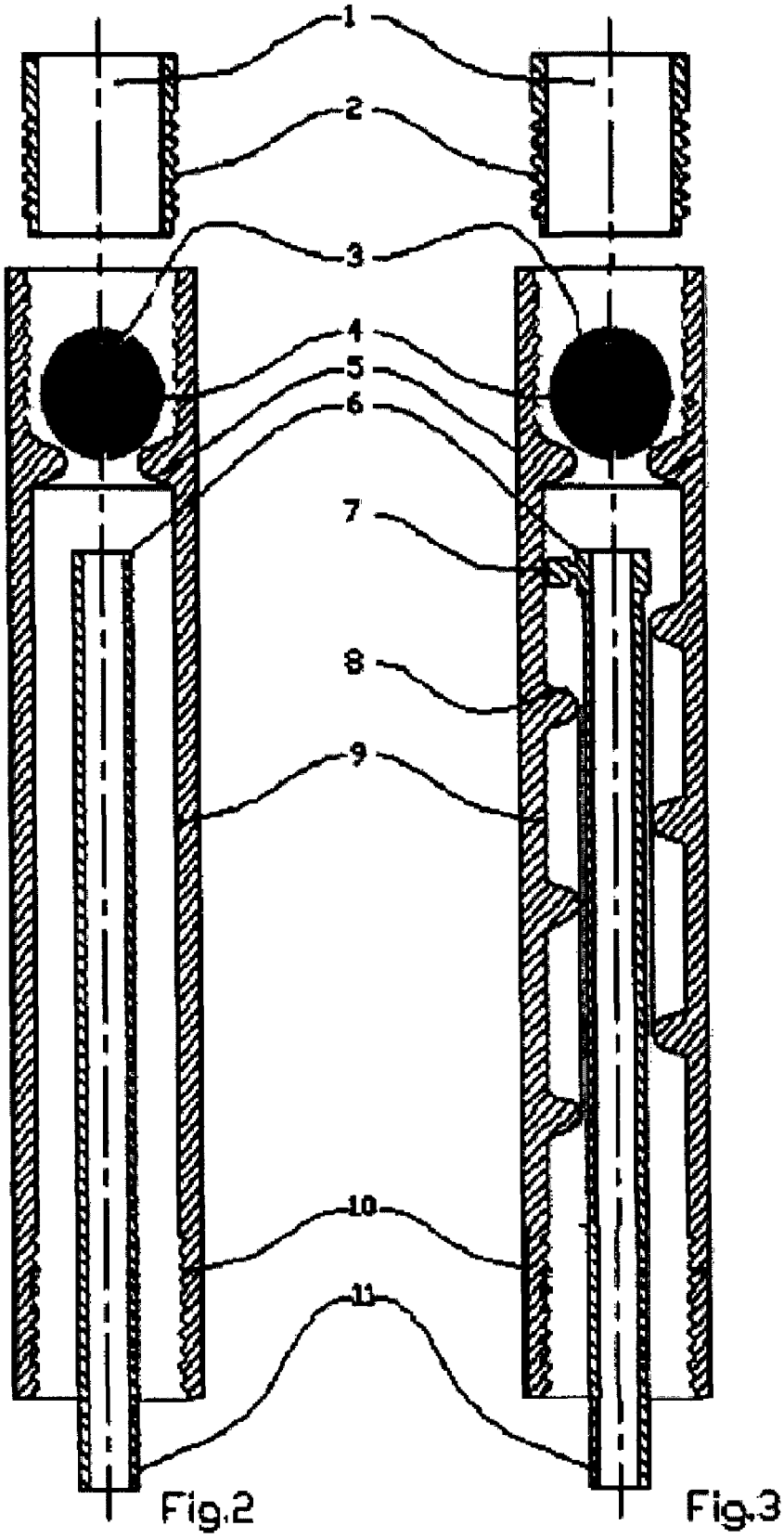
FIGS. 2 and 3 are views showing an adaptor of the inventive system in accordance with two embodiments of the present invention.
Figure 4:
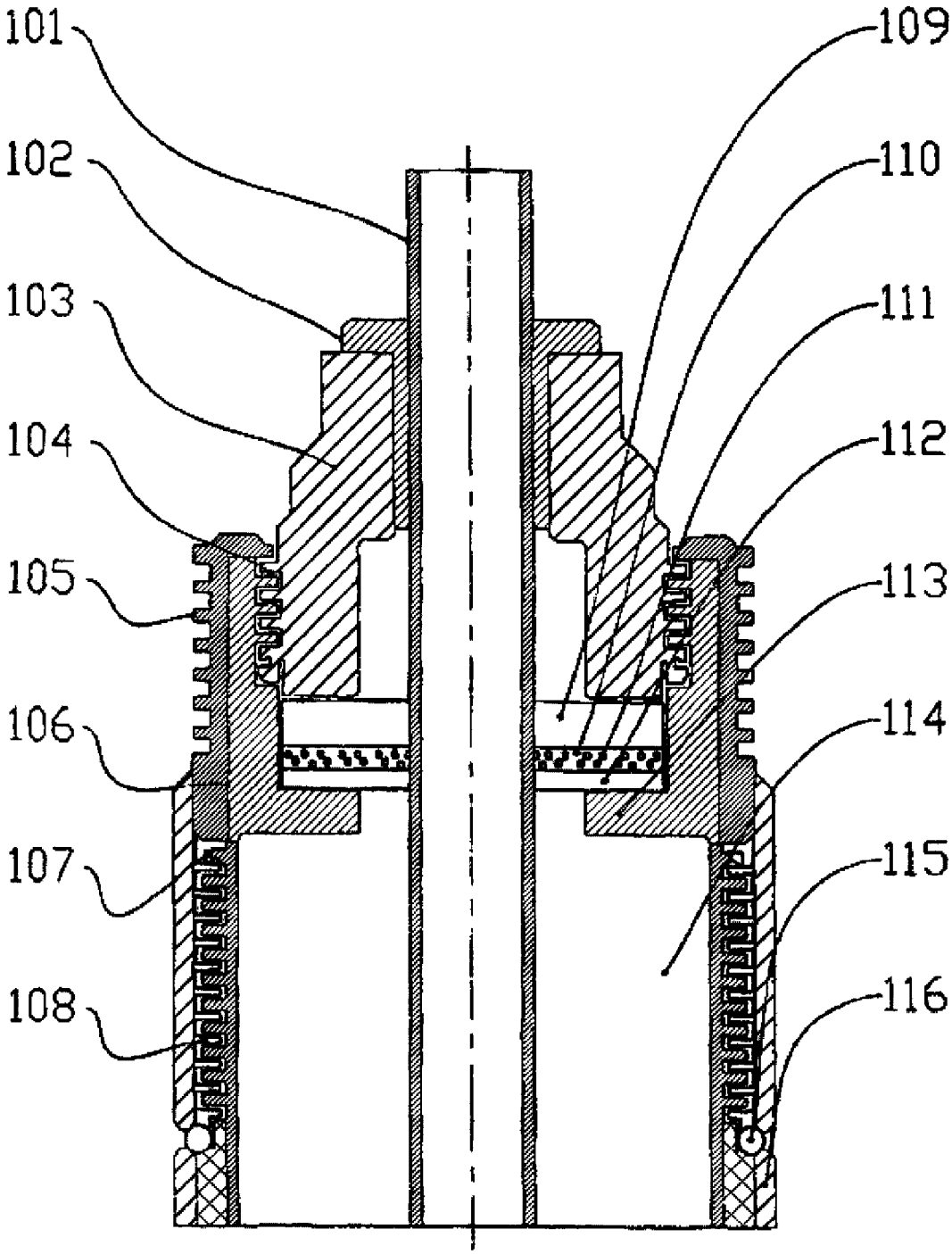
FIGS. 4-6 show a hydraulic block of the system in accordance with the present invention.
Figure 5:
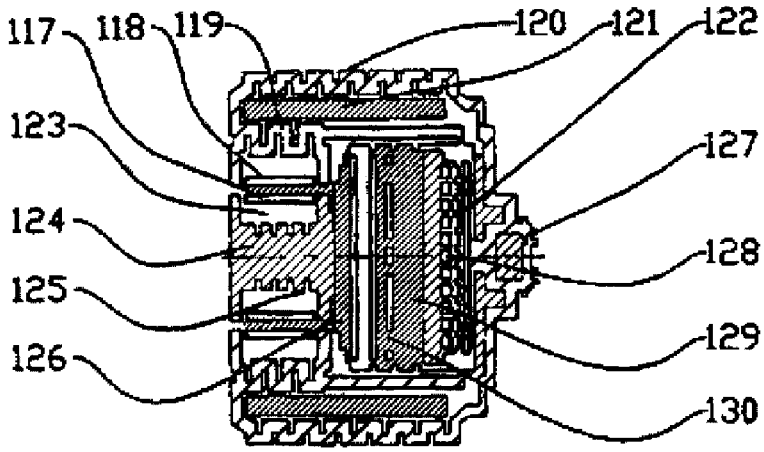
Figure 6:
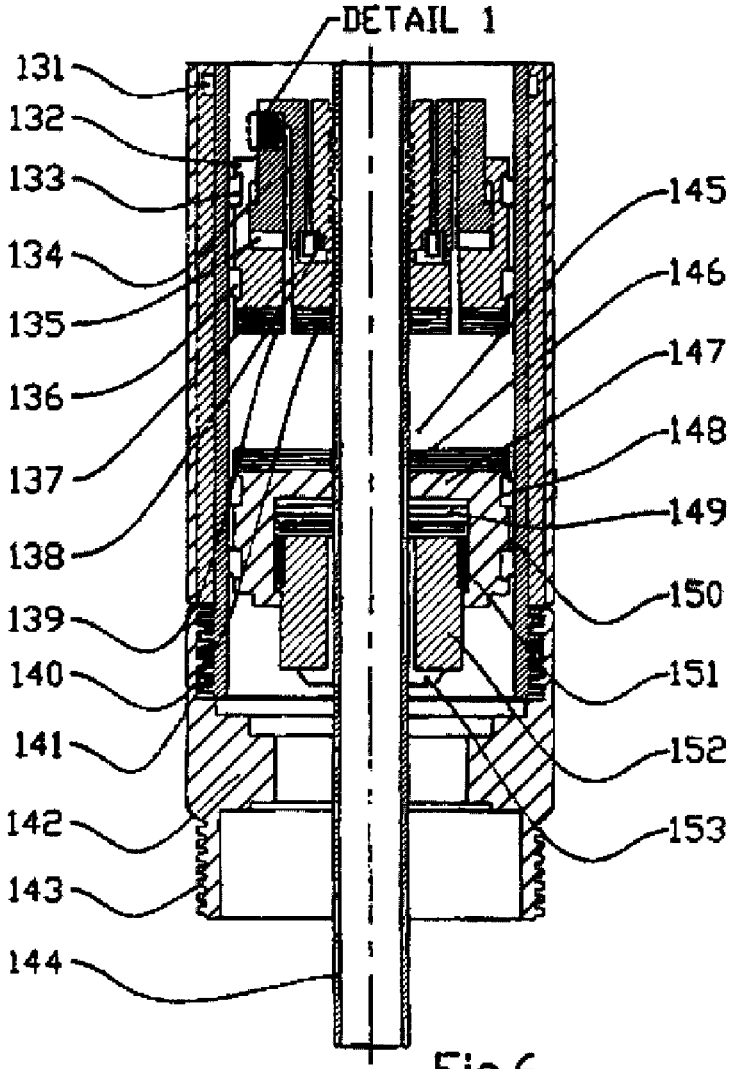

FIGS. 2 and 3 show two different embodiments of the adaptor A of the inventive system. The adaptor is located in an upper part of the system and is formed as a tubular cylinder. A lower end of a working tubing 1 has an outer thread 2 with which the tubing 1 is screwed into an upper end 4 of the adaptor. A ball 3 is provided for a purpose which will be explained herein below.

The ball 3 has a diameter which is smaller than the diameter of the tubing but greater than the diameter of a seat 5 provided in the upper part of the adaptor. The adaptor has an outer thread for threading with the tubing.

Before the beginning of any operation connected with a supply of a working fluid under pressure through the tubing, it is necessary to provide testing of the tubing by supplying a pressure, generally around 7000 psi, which is 1.5 times greater than the working pressure, into the closed tubing line in order to determine leaks based on a pressure drop. Instead of testing each section of the tubing, the tubing with the assembled lower part of the system is lowered to a predetermined depth, and the ball is thrown into the tubing. The ball passes through the tubing and rests on the seat, which means that the line is secure. After this, by means of a reverse washing, the ball through the tubing is washed upwardly, and a metallic valve ball is introduced into the tubing which passes through the tubing and rests on a seat of a perforator as will be explained herein below.

An upper end of a stock of the hydraulic block is identified with reference numeral 6. Reference numerals 7, 8 and 9 identify, correspondingly a projection of the stock, a projection of the adaptor, and a wall of the adaptor. An upper end 6 of the stock from the hydraulic block is introduced into the adaptor. The lower inner thread 10 of the adaptor is used to connect the lower end of the adaptor with an upper part of the hydraulic block, whose stock is identified with reference numeral 11.

FIG. 3 shows another embodiment of the adaptor. When seismic tests have been conducted to determine an exact location of a formation and its coordinates are different from horizontal position, it is advisable to provide an opening slot at an angle of 45°, or 60°. The maximum turn of the slot along a circumference of the column must not exceed 45°. In this case the adaptor is formed so that it provides cutting of the channel at an angle.

On the upper end of the stock a special element with roller screws is provided, and then the adaptor is placed so that the roller screws 8 are engaged with inner grooves of the adaptor. The grooves in various adaptors have different angles depending of the required angle 45° or 60°. When the working fluid is introduced into the system, the stock performs a translatory movement downwardly. Due to the spirally arranged grooves, the movement is performed in a spiral-turning manner downwardly at a required angle, clockwise or counter clockwise depending on the direction of the grooves in the adaptor. Since the adaptor, hydraulic block, and return block are fixedly connected with the tubing, the system of these elements becomes immovable, while the stock together with the perforator performs the translatory-rotary movement downwardly. After the cutting of the channel is finished, the pressure of the working fluid is removed, and the stock under the action of the spring of the return block is returned to its initial position as will be explained herein below.

The hydraulic block H is located between the adaptor and the return block. It subdivides the energy of pressure of working fluid flow into two components and converts one of it into a rectilinear movement of the stock with the perforator downwardly, while simultaneously overcoming a force of compression of the springs of the return block. The second component is a pressure of the working fluid flow itself through nozzles of the perforator. The hydraulic block also determines a uniformity of the speed of movement of the stock.

A stock from the adaptor is identified with reference numeral 101. A dirt-removing element is identified with reference numeral 102. It is oil resistant and not sensitive to temperature fluctuations; it provides an initial hermetic connection and also prevents entrapping of foreign particles in working space of the hydraulic block. It is located between an upper hermetic plug 103 and the stock. The hermetic plug 103 during assembly is screwed into a thread of a lower plug so as to push to a stop sealing rings in the following sequence: 109-metallic ring, 110-fluoreplastic seal, 111-rubber seal, 112-fluoreplastic seal. This system of seals provides a reliable hermetic tightness of the inner chamber.

Reference numeral 104 identifies a connection of the lower and upper plugs of the hydraulic plug. The lower plug has an outer thread 105, on which the adaptor is screwed. In the assembled condition including the return block, the hydraulic block, the system forms a close, hermetic cylindrical tubular structure having a uniform outer diameter. A lower plug 106 of the hydraulic block is connected with the housing of the return block by an inner thread connection with the use of a fluoroplastic ring 107. The fluoroplastic ring is located between the lower plug and the housing of the hydraulic block. The inner threaded connection between the lower plug and the upper part of the housing of the hydraulic plug is identified with reference numeral 108. A metal ring 109 provides a compressing force of the upper hermetic plug to the sealing rings due to the twisting moment via the thread. Reference numeral 113 identifies a stop of the lower plug for the sealing ring. The inner working chamber of the hydraulic block 114 is filled with oil that has a certain viscosity. A sealing ring is provided between the lower plug of the hydraulic block and the upper sealing plug. The hydraulic block has a housing 116.

When liquid with abrasive component is pumped through tubes into a wellbore under high pressure and through the tubing is supplied into the system, a translatory-advanced movement of the perforator is provided along a column. The stock pulls downwardly the upper piston and also the perforator with nozzles in the lower part of the stock and simultaneously compresses a spring system in the return block. The upper piston is composed of two parts which are freely moved relative to one another in an axial direction. The lower, balancing piston part, as opposed to the upper piston part can freely slide along the stock. The inner working space of the hydraulic block to the upper sealing plug and between the pistons is filled with oil.

The beginning of the working process starts at a maximum upper position of the stock and the upper piston and a maximum lower position of the sliding piston, while the volume between the pistons is filled with oil. During the movement of the upper piston downwardly, its parts are tightly connected with one another so as to interrupt the straight oil passage and thereby activate a passage through a special capillary device. The capillary device allows passage of oil only by certain portions, and thereby the process of movement by the stock becomes slower to a certain speed. The translatory movement takes place uniformly. The sliding piston balances the pressure inside the working chamber of the hydraulic block depending on a hydrostatic pressure, in dependence on a depth of introduction of the system into the wellbore. During the operation the lower piston reaches the lower stop cover of the hydraulic block, and the oil flows through the capillary device from the space between the pistons into a compartment between the upper piston and the upper hermetic plug until the pistons come together. The coming together of the pistons means a maximum lower position of the stock. This position determines a maximum length of the working stroke of the system and correspondingly a maximum length of the canal or slot to be cut.

After the end of the working process and stop of supply of working fluid into the system, the spring of the return block which, was compressed before, is relaxed and acts on the upper stop fixedly connected with the stock. The stock moves upwardly and also moves the perforator and the upper piston of the hydraulic block upwardly. The piston, in turn, pulls its lower part so as to open a direct oil passage. During the working process oil flows only through the canal with a capillary device, while the direct oil canal remains tightly closed by the rubber ring with a petal disk. The oil without any resistance flows through the direct oil canal from the chamber between the upper sealing cover of the hydraulic block into a space between the fixed and the sliding pistons which move away from one another. The system is returned to its initial position.

The capillary device is located in the upper immovable part of the piston fixed on the stock of the hydraulic block. The capillary device provides a certain constant speed of movement of the stock with the perforator during the whole working process.

During return of the system to a working position, the stock is moved upwardly, and the lower part of the piston of the hydraulic block fixed on it also moves upwardly at a distance of free stroke, so as to open the direct oil passage via which oil flows without resistance from the chamber between the upper sealing cover of the hydraulic block into the space between the fixed and the sliding pistons which move apart from one another. At the beginning of the working process the piston starts moving downwardly and moves the upper immovable part of the piston fixed on it. The immovable part of the piston under the action of oil from below comes together with the upper part and hermetically closes the direct oil canal by a rubber sealing ring with the petal disk. In this position oil can flow into the upper chamber with the sealing plug only through the canal with the capillary device.

The capillary device is composed of a housing 121 and is screwed into the body of the upper part of the immovable piston of the hydraulic block by a thread connection 120. A sealing plastic ring is provided for preventing a flow of oil under the capillary device. An inlet opening for the oil 128 is located in the upper part of the body and is covered from outside by a copper net plug 127 which is formed as an oil filter. The lower side of the lower part of the housing has a spiral groove with two opposite passages so that the oil entering the capillary device through the inlet opening flows through the grooves-capillaries from the center to the sides. From above, the oil groove is covered by a round flouroplastic washer 22 in a tin ring to prevent its bulging and complete pressing into the grooves.

The diameter of the fluoroplastic washer is lower than a diameter of the housing of the capillary device, so that when oil reaches the end of the grooves it can squeeze upwardly into a gap between the body of the housing and the system of washers. The plastic washer is squeezed into the grooves and partially covers their upper part, so that by the degree of squeezing of the washer it is possible to regulate the degree of flowing of oil through the passages.

A bimetal washer 129, 130 press from above onto the flouroplastic washer. In the event of increase of temperature of the borehole, the bimetal washer bends out and presses the flouroplastic washer stronger to the grooves so as to reduce the flow of oil. When the temperature in the borehole reduces the bimetal washer applies lower pressure on the plastic washer and the flow of the oil increases and the speed of the stock stabilize. The bimetal washer is pressed by the metallic washer 125 with a semi-sphere or cone in the upper part of the bottom. Therefore oil which flows between the walls of the capillary device and the system of washers flows from the side upwardly and through the channels in the upper tin cover flows outside in the space between the upper part of the immovable piston and the upper sealing cover of the hydraulic block into the space. The upper pressing cover 123 has two oil passages for flowing the oil from the capillary device outwardly.

The housing of the hydraulic block is identified with reference numerals 131, 132 is an inner working space of the hydraulic block filled with oil, 133 is a body of the lower part of the upper working immovable piston, 135 is an oil passage located inside the immovable part of the upper working piston of the hydraulic block to the capillary device, 135 identifies empty spaces which are formed during a movement of the immovable part of the upper working piston with the stock upwardly. In this case the rubber valve 137 with a petal disk is open, the direct oil canal is open as well, and oil without any resistance flows from the space between the pistons into the chamber between the upper immovable piston of the hydraulic block and the lower sealing cover. A plastic and rubber sealing rings of the upper immovable piston are identified with reference numeral 136. The rubber valve with the pedal disk which interrupts the direct oil passage during the translatory movement of the stock with the upper immovable piston downwardly is 138. 139 is a working surface of the upper immovable piston of the hydraulic block, while 140 is an inner surface of the hydraulic block. 141 illustrate a body of the hydraulic block which is downwardly connected with the lower sealing cover 142 by a thread. The stop of the lower cover 142 limits an outward movement of the stock and lower sliding piston of the hydraulic block.

The lower part of the hydraulic block is connected with the return block by a thread 143. At 144 the lower part of the stock of the hydraulic block is connected with the upper part of the stock of the return block via a coupling. 145 and 146 identify a working surface of the lower sliding piston and a lower working space of the hydraulic block between the working pistons, which is filled with oil. 147 identifies an upper part of the lower sliding piston of the hydraulic block, while 148 and 151 identify fluoroplastic and rubber sealing ring of the upper immovable piston of the hydraulic block. 149 and 150 identify sealing rings, while 152 identifies a lower part of the lower sliding piston which is screwed into the upper part of the lower sliding piston of the hydraulic block by a thread. Finally, the dirt removing element is identified with reference numeral 153.

Figure 7:
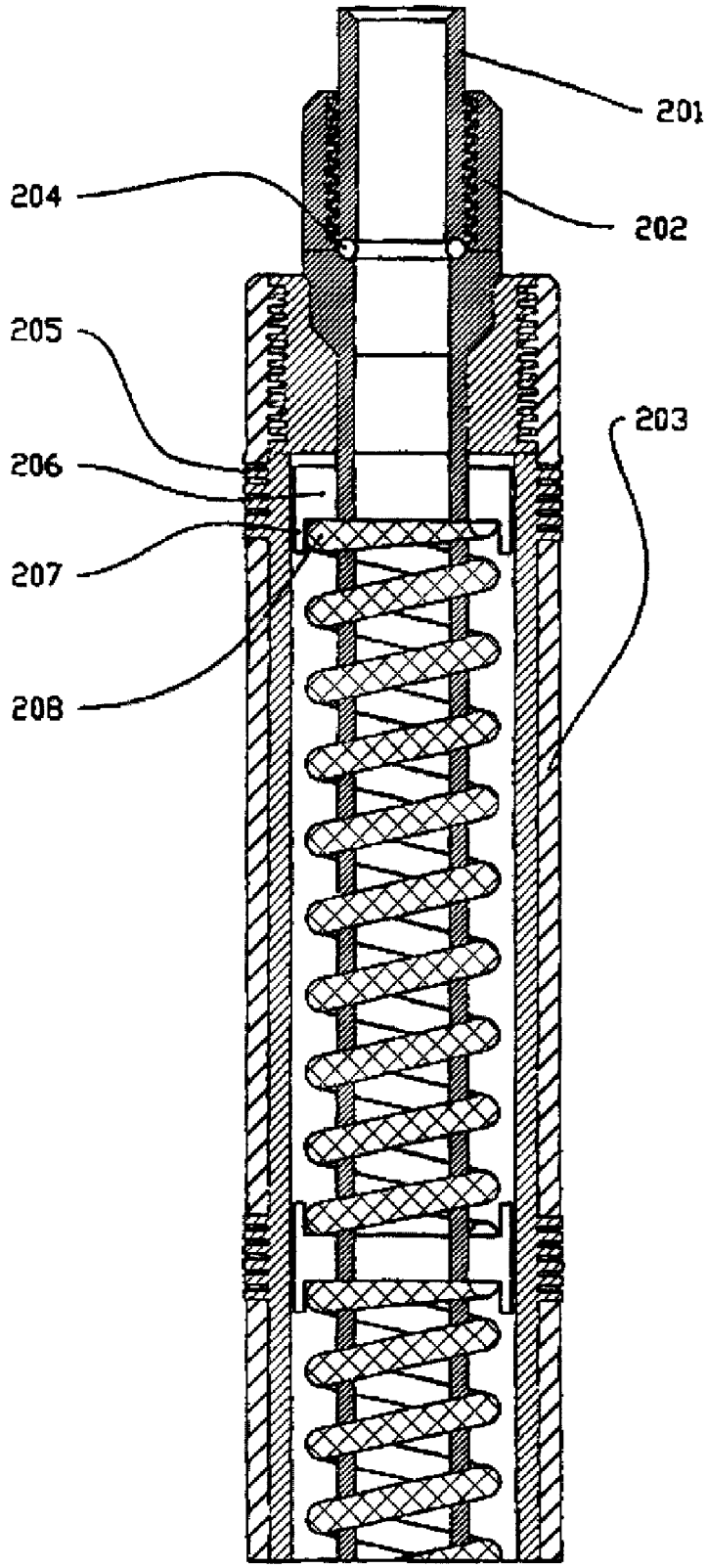
FIGS. 7-9 show a return block of the system in accordance with the present invention.
Figure 8:
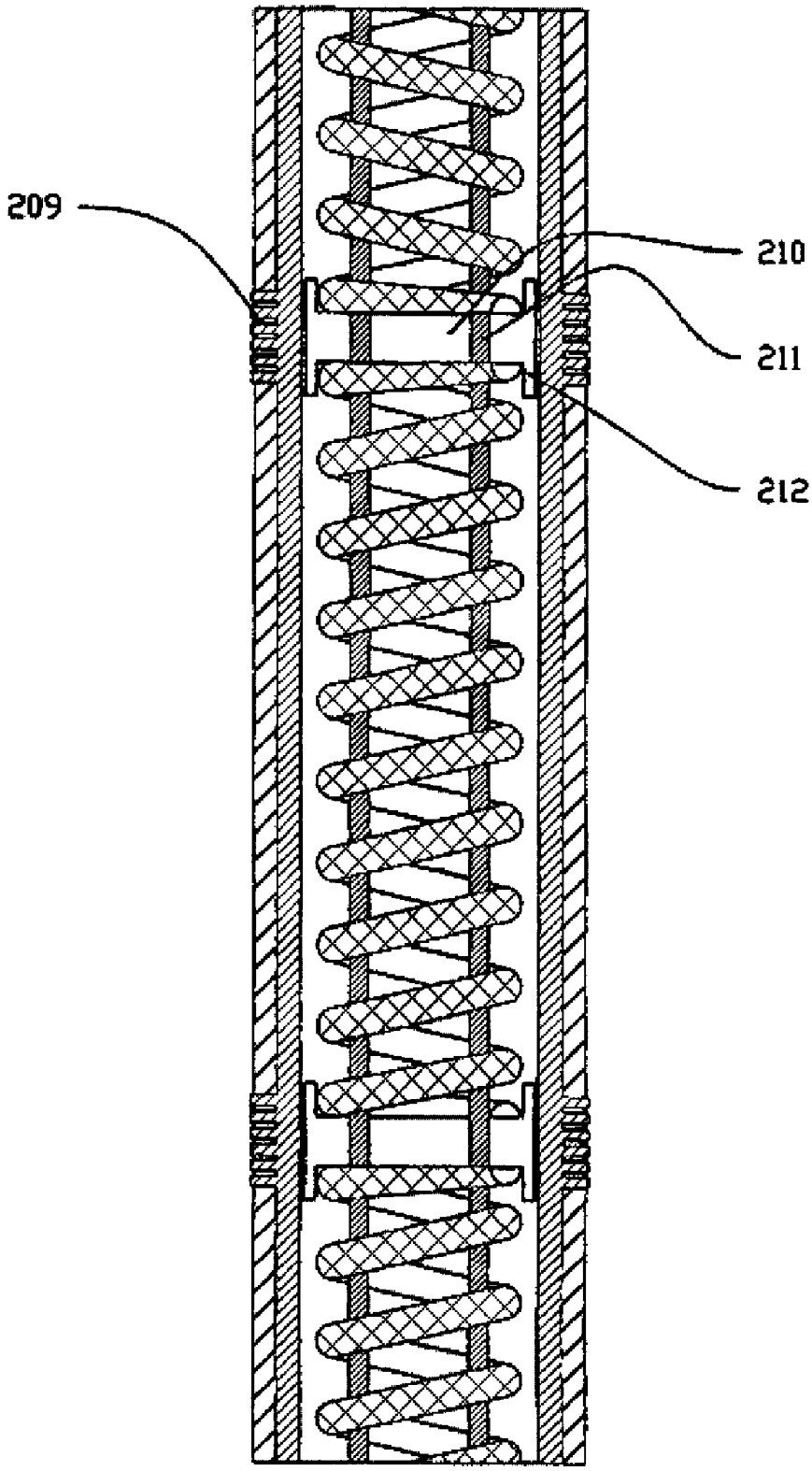
Figure 9:
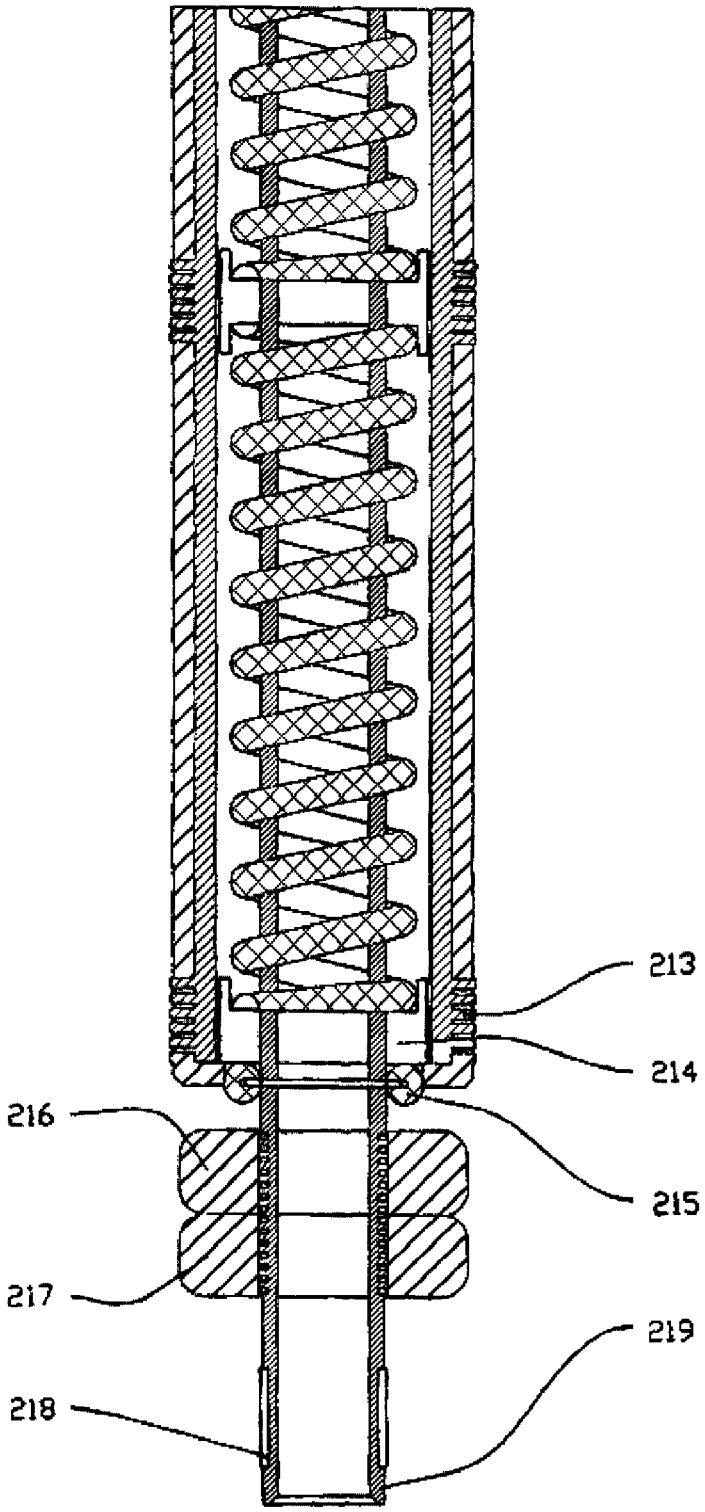

The return block R is located between the hydraulic block and the perforator and is illustrated in FIGS. 7, 8 and 9.

A stock from the hydraulic block is identified with reference numeral 201, while a coupling connecting the stock from the hydraulic block to the return block is identified with reference numeral 202 and has a conical thread. When the stocks are connected with one another, the bodies of the hydraulic block and the return block are connected to form a closed system. A surface of the body of the return block is a smooth, streamline cylinder providing a lower friction over its surface of the particles of rock and slacks. A flouroplastic ring 204 in the coupling provides an additional hermetic tightness and prevents flow of the working fluid in the stock connection. The body has grooves on the outside for a tool for assembly, disassembly of the unit. The upper spring stop 106 is fixed in the upper part of the stock of the return block by a thread. The spring stop abuts against the coupling which limits its upward movement. During the translatory movement of the stock downwardly when the working fluid is supplied under pressure, the stock starts the translatory movement which is transmitted to the spring stock fixed on the stock, and the upper spring stock compresses the spring system of the return block. A reinforced fluoroplastic ring 207 is provided and allows the spring stop to slide along the inner surface of the cylindrical body of the return block. Reference numeral 208 identifies a spring system of the return block which can include five systems.

The block can include five spring systems separated from one another by intermediate stops with plastic rings. The springs operate for compression, and the force of compression is selected so that it does not negatively affect the movement of the stock downwardly under the action of the working liquid. When the pressure in the system is stopped, the pressure on the springs by the upper spring stop stops, the springs return to their initial (relaxed) position by the upper spring, by means of the upper spring stock to return the stock together with the perforator to the upper initial position.

Reference 209 identifies the grooves on the outer surface for assembly that disassembly of the aggregate. References 210, 211, 212 identify intermediate stops, while references 13, 213, 214, 215 identify lower springy stop for the last spring. A limiting nut 216 serves for preventing breakage of the hydraulic block and the system as a whole during the redistribution of a load in the case of accidental or predesigned lowering of the perforator and the whole system to the object, in which case the nut abuts against the lower part of the return block. The counter nut 217 for the nut 216 prevents its unscrewing in the case of vibrations. 218 identifies a threaded connection of the stock 219.

Figure 10:
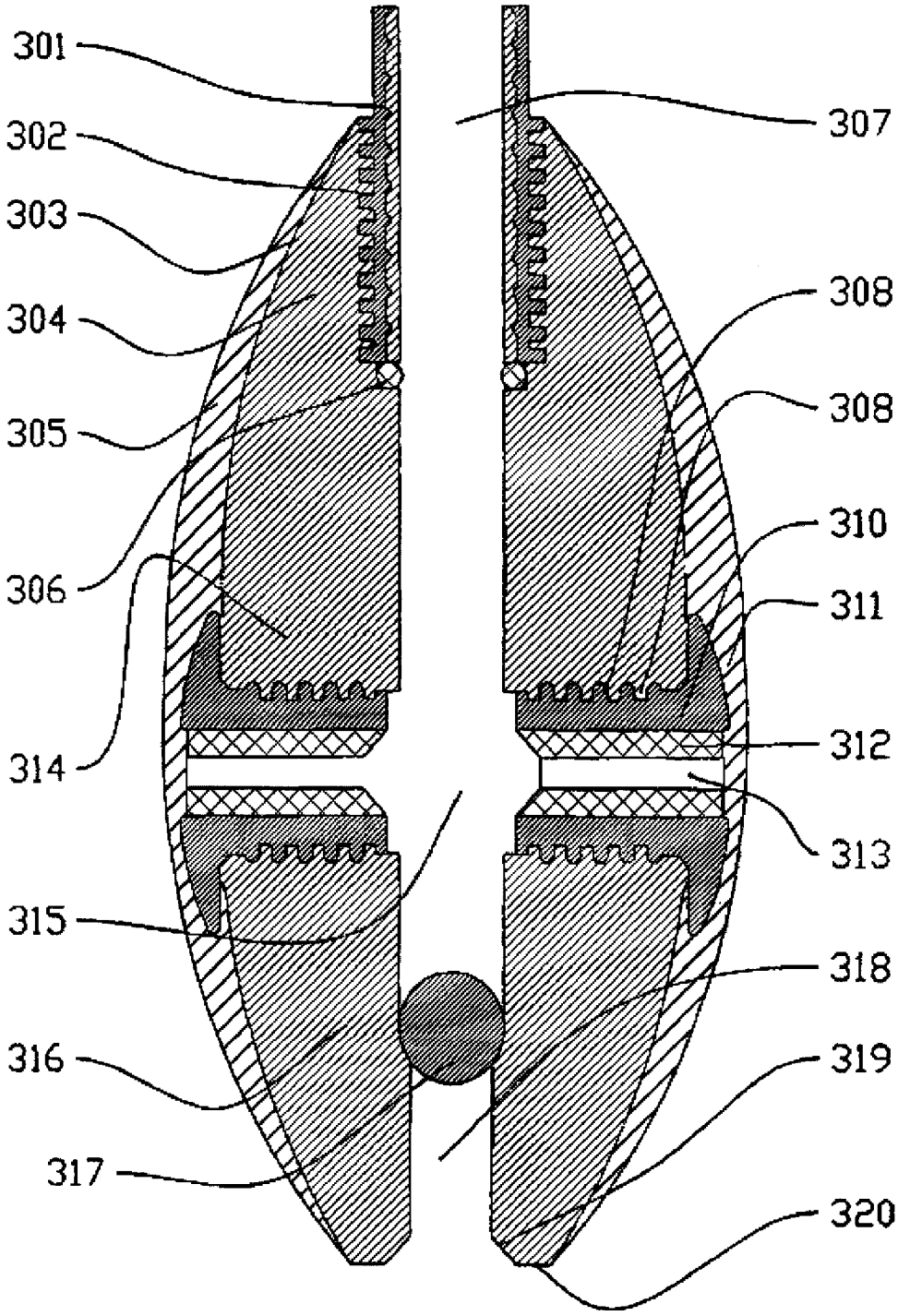
FIG. 10 is a view showing a perforator of the system in accordance with the present invention.
Figure 11:
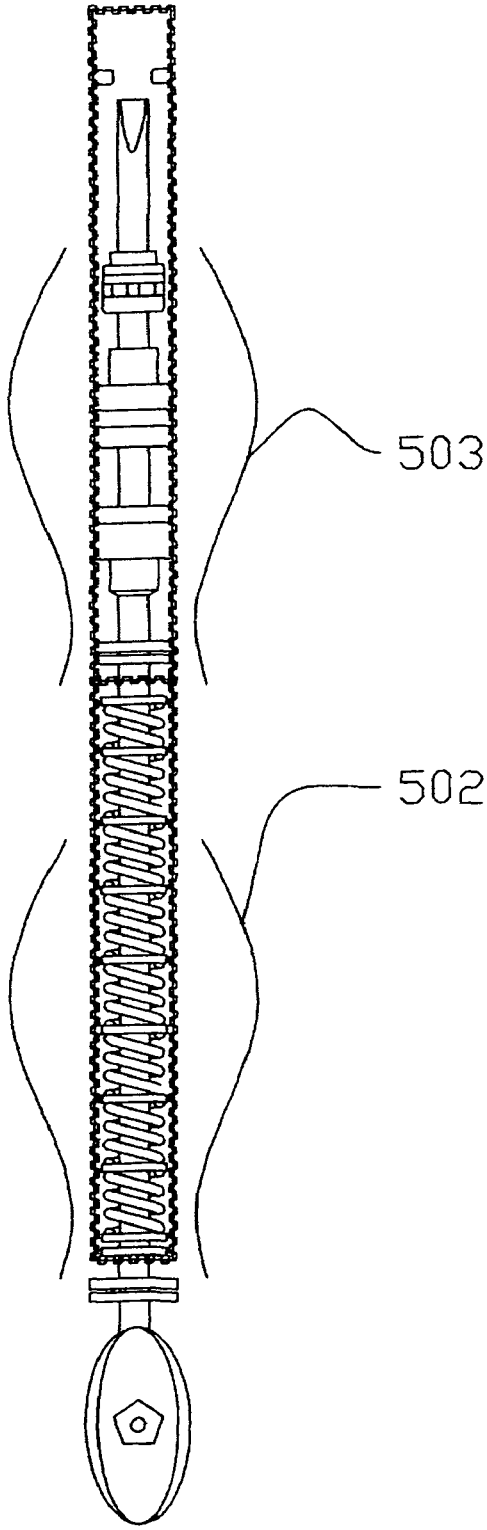
FIG. 11 is a view showing an additional device for the system in accordance with the present invention.

The perforator P of the inventive system is shown in FIG. 10. Reference numeral 301 identifies a stock from the return block, while reference numeral 302 identifies a coupling with a conical thread for connecting the perforator to the stock of the return block. Reference numeral 303 identifies a surface of the body of the perforator which has a smooth streamline shape without sharp edges and flat surfaces. This provides a lower friction against a surface of the perforator by the particles of the rock and refuse which are washed during the operation, increases wear resistance to mechanical damages, and increases a service live of the perforator. The body 304 of the perforator is a solid, one-piece body composed of mechanically strong steel. The inner surface of the perforator and like the outer surface has a smooth streamline shape. A total shape can have an oval configuration on a side view.

The perforator has a guiding rib 305, for example four guiding ribs arranged at an angle of 90° relative to one another. They are composed of a strong steel and their shape can copy the surface of the perforator. On the other hand the ribs can be straight and mounted on the body of the perforator. The ribs increase the strength of the construction from side stresses, and prevent the holders with the nozzles from external damages. The stock of the return block is connected with a perforator by a threaded connection 306. The inner surface of the stock from the return block 307 has a uniform inner diameter along the whole length including the return block and the piston block. The perforator has nozzles 308. They include the nozzles themselves and their holders.

The nozzles are located in the body of the perforator at its sides, preferably in diametrically opposite directions. If only two diametrically opposite nozzles are used, the remaining two are closed by the plugs. The holders with the nozzles are fixed in the body of the perforator by a conical thread 309. The nozzle holders 310 are composed of a high strength steel, and they are wear-resistant, and resistant to mechanical deformations. A nut 311 of the nozzle holder is formed integral with the holder and has a hexagon for screwing into the perforator. The nozzle 312 is an insert, preferable composed of a hard alloy. The inner opening 313 of the nozzle can have a cone with an apex from the perforator.

The inner chamber of the perforator is identified with reference numeral 314, while the inner chamber where a change of the straight direction of working fluid to a flow into working nozzles is identified as 315. A seat of the valve wall is identified with reference numeral 315, and the valve wall is identified with reference numeral 317. The ball 316 is used as a valve which closes an opening in the lower part of the perforator. Liquids and solutions are supplied till the ball falls downwardly and rests in the seat so as to interrupt the direct flow of the working fluid and directs it into the nozzles. After the end of the working process, the reverse flow moves the ball upwardly through the tubing.

The lower opening 318 of the perforator has an inner diameter which is smaller than the inner diameter of the line including the adaptor A, the hydraulic block H and the return block R and smaller than the diameter of the ball. A cone 319 is located in the lower part of the opening of the perforator for improving the operation of direct-reverse washing due to increase of an area. The lower end of the perforator 320 is the only flat part and it is of one piece with the perforator. It is designed to prevent damage to the perforator from below as a result lowering of the perforator to the object.

When the inventive system is used for opening of productive formations in vertical and horizontal oil, gas and hydrogeological wells, forming in the productive formation of slot-shaped channels of a high depth and area is provided, which contributes to unloading of the complicated stress conditions of the rocks in the near-well zone and increase of the area of filtration. Better conditions are provided for improvement of permeability of collectors and, as a result, a deep, stable hydrodynamic connection between the well and the formation is provided, which leads to intensification of production flows in industrial wells. The use of the system provides efficient opening of the casing of the well and creation of a channel of a great depth and area, formation of voluminous highly-permeable near-well zone, establishes a long-term, deep, and reliable hydrodynamic connection of the well with the formation, which is efficient even when the other known, existing equipment did not provide expected results.

The additional device includes centering springs which formed, for example, as two sets of springs 503 and 502 each composed of a plurality, for example five, elongated strips spaced from one another in a circumferential direction around the axis of the system. One end of the springs is fixed to the system, while the other end is not fixed and is free to move. When the system is introduced into a wellbore the springs 503 and 502 compress and provide centering of the system relative to the walls of the borehole during the operation.

It will be understood that each of the elements described above, or two or more together, may also find a useful application in other types of methods and constructions differing from the type described above.

While the invention has been illustrated and described as embodied in a slot-perforating system for oil, gas and hydrogeological wells, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A slot-perforating system for an abrasive-hydro-slotting of a near well-bore zone for establishing an inflow path between a borehole and a formation, comprising an adaptor connectable to a tubing; a hydraulic block connected to said adaptor for regulating a speed of operation; a perforator providing a hydro-slotting, and a return block located between said hydraulic block and said perforator and returning said perforator an initial upper position, wherein said perforator has a streamline shape substantially without sharp edges and flat surfaces.

2. A slot-perforating system as defined in claim 1, wherein said adaptor is formed so that during a downward movement said perforator is turnable around a vertical axis to provide a cut at an angle.

3. A slot-perforating system as defined in claim 2, wherein said adaptor and a tubing are provided with a plurality of spiral-shaped grooves with formations engaging in said grooves to generate a spiral movement of said perforator which produces said angular cut.

4. A slot-perforating system as defined in claim 1, wherein said perforator is formed as a body of rotation around a substantially vertical axis with a substantially elliptical vertical cross-section.

5. A slot-perforating system as defined in claim 1, wherein said hydraulic block includes pistons displaceable relative to one another.

6. A slot-perforating system as defined in claim 1, wherein said hydraulic block includes capillary means for flowing a hydraulic fluid therethrough.

7. A slot-perforating system for an abrasive-hydro-slotting of a near well-bore zone for establishing an inflow path between a borehole and a formation, comprising an adaptor connectable to a tubing; a hydraulic block connected to said adaptor for regulating a speed of operation; a perforator providing a hydro-slotting, and a return block located between said hydraulic block and said perforator and returning said perforator an initial upper position; and centering elements configured for centering said system in a wellbore and including at least one set of springy elements which are spaced from one another in a circumferential direction about a vertical axis and each extending along a vertical axis around the system to abut against an inner surface of a wellbore when the slot perforating system is located in said wellbore and another set of said spring elements which is offset from said first mentioned set, and wherein each of said spring elements has one end is connected to said system and another end which is not connected to the latter.

8. A slot-perforating system for an abrasive-hydro-slotting of a near well-bore zone for establishing an inflow path between a borehole and a formation, comprising an adaptor connectable to a tubing; a hydraulic block connected to said adaptor for regulating a speed of operation; a perforator providing a hydro-slotting, and a return block located between said hydraulic block and said perforator and returning said perforator an initial upper position, wherein said hydraulic block includes means for regulating a supply of a hydraulic liquid depending on a temperature in the borehole, wherein said regulating means include a bimetal regulating means which change their orientation in dependence on the temperature in the borehole.

9. A slot-perforating system for an abrasive-hydro-slotting of a near well-bore zone for establishing an inflow path between a borehole and a formation, comprising an adaptor connectable to a tubing; a hydraulic block connected to said adaptor for regulating a speed of operation; a perforator providing a hydro-slotting, and a return block located between said hydraulic block and said perforator and returning said perforator an initial upper position, wherein said return block include spring elements providing the return of said perforator and including a plurality of springs which are arranged one after the other in a vertical direction.

10. A slot-perforating system as defined in claim 9, wherein said return block includes a cylinder accommodating said springs, connecting rods located inside said springs, stop elements provided between said springs, and ring elements surrounding each of said stop elements and sliding over an inner surface of said cylinder.

11. A slot-perforating system as defined in claim 10, wherein said ring elements are configured as elements having a low friction with the inner surface of said cylinder.

* * * * *